United States Patent [19]

Martin

[11] Patent Number: 4,958,403

[45] Date of Patent: Sep. 25, 1990

[54] BAR-B-QUE GRILL SCRAPER

[76] Inventor: LaVerne L. Martin, 438 N. 5 St., Chariton, Iowa 50049

[21] Appl. No.: 353,043

[22] Filed: May 17, 1989

[51] Int. Cl.[5] ..... A47L 17/06

[52] U.S. Cl. ..... 15/236.07; 15/104.04; 15/105; 15/236.09; D32/49

[58] Field of Search ..... 15/104.04, 105, 236.05, 15/236.07, 236.01, 236.09; 30/169, 172; D4/118; D32/46, 49

[56] References Cited

U.S. PATENT DOCUMENTS

| | | | |
|---|---|---|---|
| 790,228 | 5/1905 | Rohrer | 15/236.07 |
| 2,810,144 | 10/1957 | McIntosh | 15/236.05 |
| 2,824,323 | 2/1958 | Tos et al. | 15/236.05 |
| 3,366,987 | 2/1968 | Giustino | 15/105 |
| 3,800,354 | 4/1974 | Stephens | 15/104.04 |
| 3,820,185 | 6/1974 | Philips | 15/105 |
| 4,112,537 | 9/1978 | Heuck | 15/105 |
| 4,214,342 | 7/1980 | Amundsen | 15/105 |

FOREIGN PATENT DOCUMENTS

| | | | |
|---|---|---|---|
| 127180 | 1/1950 | Sweden | 15/236.05 |

*Primary Examiner*—Harvey C. Hornsby
*Assistant Examiner*—Mark Spisich
*Attorney, Agent, or Firm*—Donald J. Breh

[57] ABSTRACT

A tool for scraping a grill of the type having a plurality of spaced apart parallel grill rods is disclosed. The scraper includes an elongated handle having a flat rectangular scraper member transversely attached to one end of the handle. The scraper member includes at least one access slot opening at one edge transversely intersected by a cross slot having ends shaped and sized to receive at least one grill rod of predetermined shape and size.

9 Claims, 1 Drawing Sheet

Fig. 1
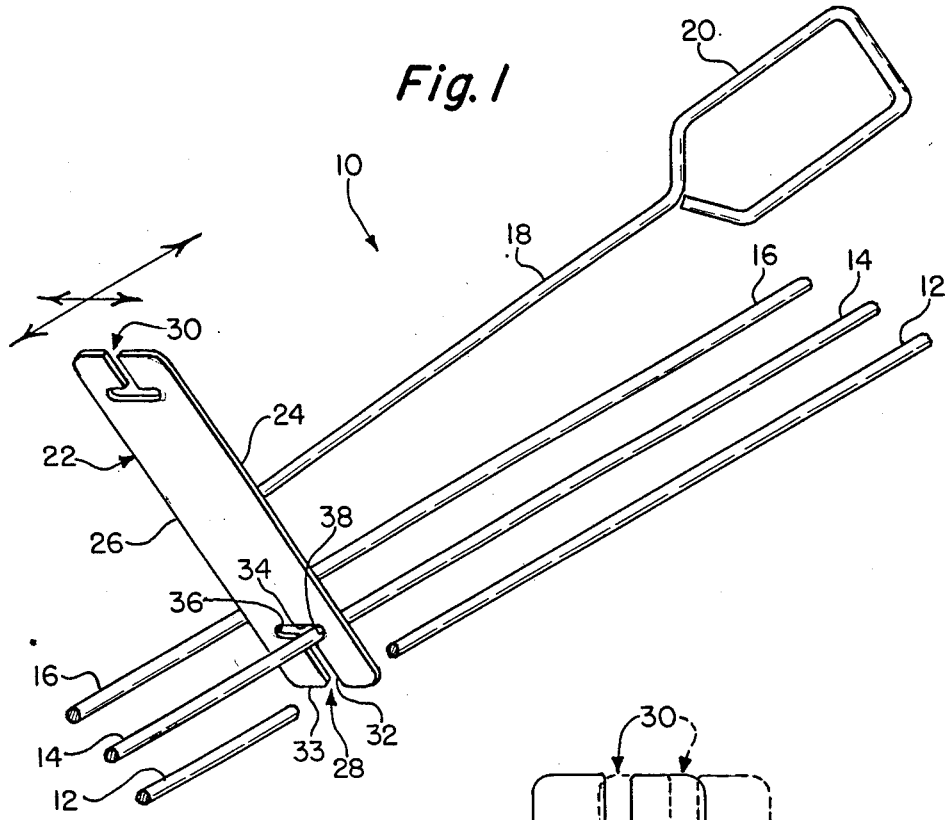
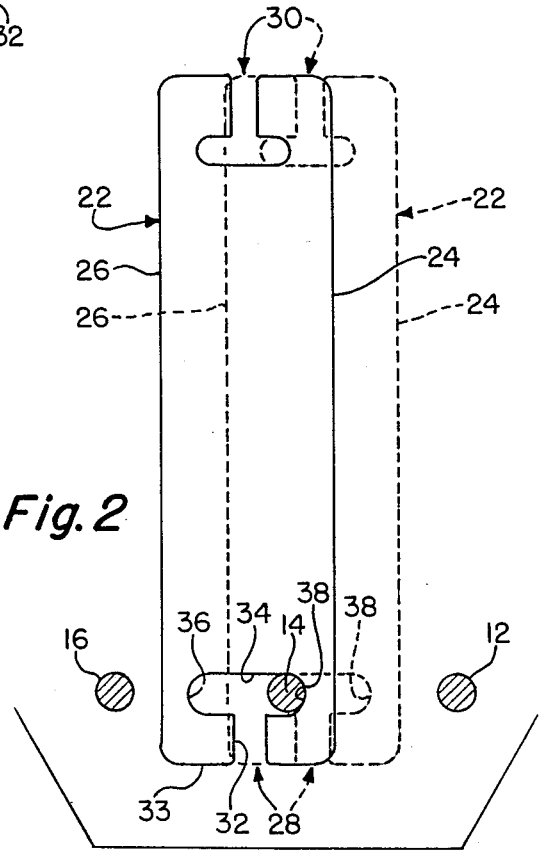
Fig. 2

BAR-B-QUE GRILL SCRAPER

BACKGROUND OF THE INVENTION

This invention relates to a tool for cleaning a grill. More particularly, the invention relates to a tool for scraping a grill of the type having a plurality of spaced apart parallel grill rods such as a barbecue grill.

Tools of this type are disclosed in U.S. Pat. Nos. 2,824,323, 3,820,185, 4,112,537 and 4,214,342. These tools all have certain limitations such as being effective on only one grill rod size, or shape, limits in the surface area of the grill rod that can be scraped or cleaned with a single pass of the tool over the grill rod and a high degree of manipulation of the tool to effect scraping of all surface areas of the grill rod effectively.

SUMMARY OF THE INVENTION

The present invention provides for a simply constructed tool which provides for efficiently scraping at least one shape and size of grill rod and includes a T-shaped implement including an elongated handle having a scraper member transversely mounted to one end.

According to the invention, the scraper member is a generally flat member the plane of which is disposed perpendicular to the handle and is provided with at least one T-shaped opening for receiving at least one grill rod shape and size.

According to an important feature of the invention, the T-shaped opening includes an access slot opening at one edge of the scraper member and a cross slot transversely intersecting the access slot at the end of the access slot opposite the opening.

According to the invention, the width of the access slot and cross slot are shaped and sized to receive a predetermined grill rod shape and size and at least the opposing ends of the cross slot are shaped and sized substantially the same as the shape and size of the predetermined grill rod to effect scraping of the surface of the grill rod.

According to another feature of the invention, the scraper member is provided with a second T-shaped opening at an edge opposite the one T-shaped opening and is configured to receive a grill rod having a different size and or shape.

BRIEF DESCRIPTION OF THE DRAWINGS

The invention will be better understood after reading the following Detailed Description of the Preferred Embodiment in conjunction with the drawing of which;

FIG. 1 is a pictorial view of a preferred embodiment of the invention showing details of construction and use; and FIG. 2 is an end view of the tool in FIG. 1 showing details of construction and use.

DETAILED DESCRIPTION OF THE PREFERRED EMBODIMENT

Shown in FIG. 1 is a tool 10 for cleaning a grill of the type such as a barbecue grill having a plurality of spaced apart parallel grill rods, only three of which 12, 14, 16, are shown. The tool is adapted to scrape food and other deposits from the entire surface of the grill rods with a simple longitudinally reciprocating and transversely reciprocating motion, as shown by the arrows in FIG. 1.

The tool includes an elongated handle portion !8 which may be provided with an insulating or easily gripped portion 20. Preferrably, the handle is metallic and may be any desired length which preferrably provides for maintaining the user's hand a safe distance from the surface of the grill should it be hot from use. Attached transversely to one end of the handle is a scraper member 22 preferrably being a flat rectangular metallic member of, for example, about 3 inches in length. The width of the scraper member can vary depending on the spacing of the grill rods of the grill with which the tool is contemplated to be used to clean. The width of the scraper member is sized so that when placed over a grill wire, as shown in the drawing and as described below, its long edges 24, 26 will not hit adjacent grill rods such as 12 and 16 in FIG. 2, when reciprocated transversely over the grill rod being scraped, such as the rod 14 in FIG. 2.

The scraper member is provided with at least one T-shaped opening 28 at one end but preferrably is also provided with a second T-shaped opening 30 of a different size and or shape at the opposite end. The structure and operation of the T-shaped openings are the same except that they accommodate different sizes and or shapes of grill rods and accordingly only one opening 28 will be described herein in detail.

The opening 28 includes an access slot 32 opening at one edge 33 of the scraper member and is located and extends along the principal longitudinal axis of the scraper member. The access slot 32 is shaped and sized to receive a grill rod of a predetermined shape and size such as, for example, a common ⅛ or 5/32 inch diameter grill rod. The opposite or inner end of the access slot 32 is intersected by a transverse cross slot 34 which extends an equal distance on opposite sides of the access slot. As shown in FIG. 2, each end 36, 38 of the cross slot is shaped and size to conform substantially to the shape and size of the predetermined grill rod's shape and size. Preferrably, the ends of the cross slot are sized to receive the grill rod with a slight clearance to effect scraping of the surface of the rod while allowing some angulation of the handle away from the grill surface as shown in FIG. 1. Also, the distance which the cross slot extends on either side of the access slot should be not less than about ½ the cross sectional dimension of the grill rod. Accordingly, opposite halves of the surface of the grill rod are scraped when it is received against each respective end 36, 38 of the cross slot. Of course, the cross slot can be longer if desired, such as shown in FIG. 2, where the total length of the cross slot is about three full rod diameters. Most common grill rods are cylindrical and the cross slot ends are therefore semicircular having a diameter at least equal to the known diameter of the grill rod. It should be noted that, although grill rods are typically cylindrical, the cross slot ends 36, 38 could be squared to accept a grill rod having a square cross sectional shape if such application is contemplated.

As noted, the opening 30 at the opposite end of the scraper member is essentially identical to the opening 28 except that it is sized and shaped to receive and scrape a grill rod of a different predetermined size and or shape.

In use, the scraper member is placed on a grill rod by positioning the rod through the access slot 32 into the cross slot 34 against either of the opposing ends 36, 38, such as end 38 shown in solid lines in FIG. 2. The tool is reciprocated longitudinally over the length of the grill rod whereby at least ½ the surface of the rod is scraped. Subsequently, the scraper member is moved laterally to position the grill rod 14 against the opposite end 36 of the cross slot, as shown in dashed outline in FIG. 2, and the scraper member is again reciprocated longitudinally over the length of the grill rod so as to scrape the other half of the rod surface. Obviously, the tool can be reciprocated both longitudinally and transversely between the ends of the cross slot simultaneously. After scraping, the tool is removed by aligning the access slot with the rod and lifting the scraper clear. The tool is then moved to other grill rods to be scraped in the same manner.

Having described the Preferred Embodiment of the Invention, those skilled in the art having the benefit of the description can readily devise other embodiments and modifications and such other embodiments and modifications are to be considered to be within the scope of the appended claims.

What is claimed is:

1. A tool for scraping a grill having a plurality of spaced apart parallel grill rods comprising:

a generally T-shaped implement including an elongated handle and a substantially flat scraper member at one end of said handle disposed transversely to the handle, said scraper member including at least one T-shaped opening including a first slot having an open end centrally along one edge of said scraper member and a first cross slot transversely intersecting said first slot at an end of said first slot opposite said open end of said first slot, the first cross slot extending an equal distance across said first slot and having opposite closed ends substantially conforming to a predetermined grill rod transverse cross sectional shape and size, such that opposite sides of said grill rod can be scraped in each of said opposite closed ends.

2. The tool as defined in claim 2 wherein the shape of said closed ends of said first cross slot are semicircular.

3. The tool as defined in claim 1 wherein said scraper member includes a second generally T-shaped opening including a second slot having an open end centrally along a second edge of said scraper member opposite said one edge and a second cross slot transversely intersecting said second slot at an end of said second slot opposite said open end of said second slot, the second cross slot extending an equal distance across said second slot and having opposite closed ends substantially conforming to a predetermined grill rod transverse cross sectional size different from that of the closed ends of said first cross slot.

4. The tool as defined in claim 3 wherein the shape of said closed ends of said second cross slot are semicircular.

5. The tool as defined in claim 4 wherein said scraper member is a substantially flat and rectangular, and said first and second slots lie on the principal longitudinal axis of said scraper member.

6. The tool as defined in claim 5 wherein a plane of the flat rectangular scraper member is perpendicular to the principal longitundinal axis of said handle portion.

7. A tool for scraping a grill having a plurality of spaced apart parallel grill rods comprising:

an elongated handle;

a substantially flat scraper member attached to one end of said handle with the plane of said flat scraper member perpendicular to said handle, said scraper member including at least one access slot having an opening at one edge of the scraper member and extending along a portion of a principal longitudinal axis of the scraper member, said at least one access slot having a width at least equal to the diameter of a predetermined grill rod diameter, a cross slot having semicircular shaped opposite ends transversely intersecting said at least one access slot at an end of said at least one access slot opposite said opening and extending an equal distance across said at least one access slot, said cross slot having a width and said semicircular ends each having a diameter at least equal to the diameter of said predetermined grill rod diameter.

8. A tool for scraping a grill having spaced apart parallel grill rods comprising:

a handle;

a scraper member attached transversely to one end of the handle said scraper member including at least one T-shaped opening having an access slot opening at an edge of said scraper member and a cross slot having semicircular ends transversely intersecting said access slot at an end of the access slot opposite said opening, said access slot and said cross slot each having a width and said semicircular ends each having a diameter at least equal to a predetermined grill rod diameter, such that opposite sides of said grill rod can be scraped in each of said semicircular ends.

9. The tool as defined in claim 8 wherein said cross slot has a length at least equal to two times the diameter of said predetermined grill rod diameter and said cross slot extends an equal distance on opposite sides of said access slot.

* * * * *